US006513349B1

(12) United States Patent
Miao

(10) Patent No.: US 6,513,349 B1
(45) Date of Patent: Feb. 4, 2003

(54) LOCK IN COMBINATION WITH A NAME CARD CASE

(75) Inventor: Tony Miao, Taipei Hsien (TW)

(73) Assignee: Jin Tay Industries Co., Ltd., Taipei Hsien (TW)

( * ) Notice: Subject to any disclaimer, the term of this patent is extended or adjusted under 35 U.S.C. 154(b) by 0 days.

(21) Appl. No.: 10/078,597

(22) Filed: Feb. 19, 2002

(51) Int. Cl.[7] ..... E05B 37/14; E05B 73/00

(52) U.S. Cl. ..... 70/57; 70/28; 70/58; 70/63; 70/69; 40/655; 206/38; 206/39

(58) Field of Search ..... 70/28, 57, 57.1, 70/58, 63, 69; 40/1.5, 661, 655, 661.04; 206/1.5, 38, 39

(56) References Cited

U.S. PATENT DOCUMENTS

| | | | | | |
|---|---|---|---|---|---|
| 211,250 | A | * | 1/1879 | Mohr | 40/655 |
| 272,036 | A | * | 2/1883 | Fassitt | 40/655 X |
| 736,299 | A | * | 8/1903 | Rose | 40/655 |
| 1,416,559 | A | * | 5/1922 | Horvath | |
| 1,816,951 | A | * | 8/1931 | Anez Anez | |
| 1,857,399 | A | * | 5/1932 | Piagneri | |
| 4,466,540 | A | * | 8/1984 | Lotrous et al. | 206/387 |
| 4,803,856 | A | * | 2/1989 | Ling | 70/28 |
| 5,522,163 | A | * | 6/1996 | Neugebauer | 40/780 |
| 5,983,539 | A | * | 11/1999 | Martin et al. | 40/202 |
| 6,082,155 | A | * | 7/2000 | Su | 70/22 |
| 6,374,757 | B1 | * | 4/2002 | Farkash | 109/23 |
| 6,381,891 | B1 | * | 5/2002 | Hazel | 40/640 |

* cited by examiner

*Primary Examiner*—Lloyd A. Gall
(74) *Attorney, Agent, or Firm*—Alan D. Kamrath; Rider, Bennett, Egan & Arundel

(57) ABSTRACT

A lock in combination with a name card case to be used for securing and providing an identification of an item such as a suitcase. When the lock is at a securing state, a latch firmly engages a securing hook to be looped to the item. When the lock is at a releasing state, the latch disengages with the securing hook to release the item. Moreover, during the releasing state, the lock can be slid toward a side of the name card case until the lock and the name card case are separated. At this time, a name card can be received in the name card case and the lock can be slid back on the name card case again. Therefore, when the lock is used to the secure the item, the name card can provide the identification of the item.

8 Claims, 7 Drawing Sheets

LOCK IN COMBINATION WITH A NAME CARD CASE

BACKGROUND OF THE INVENTION

1. Field of the Invention

The present invention relates to the field of locks, and more specifically to a lock in combination with a name card case.

2. Description of Related Art

Locks have been invented and widely used for hundreds of years for securing items. Numerous kinds of locks are now available in the market and one of the kinds is a small lock of a key type or a combination type for securing primarily a luggage item such as a suitcase.

In practical use, especially during shipment, the suitcase is not only secured by the lock, but also a name tag identifying the owner is attached to it. However, the name tag may detach undesirably or, sometimes, information listed on the name tag may be worn out. Both these conditions are likely to cause trouble in identifying the owner or even result in loss of the suitcase and its contents.

Therefore, the present invention intends to provide a lock in combination with a name card case to mitigate and/or obviate the aforementioned problems.

SUMMARY OF THE INVENTION

The objective of the present invention is to provide a lock in combination with a name card case such that the lock can be used for securing an item while the name card case receives a name card for providing an identification of the item.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
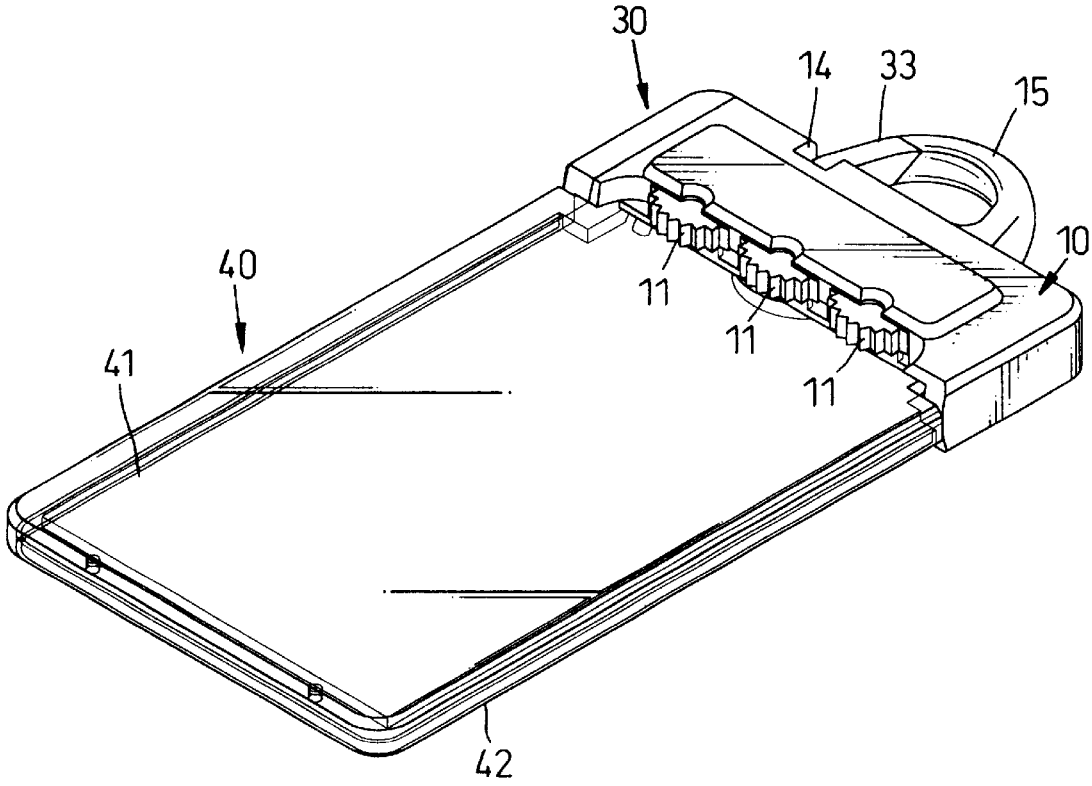
FIG. 1 is a perspective view of a lock in combination with a name card case in accordance with the present invention.
Figure 2:
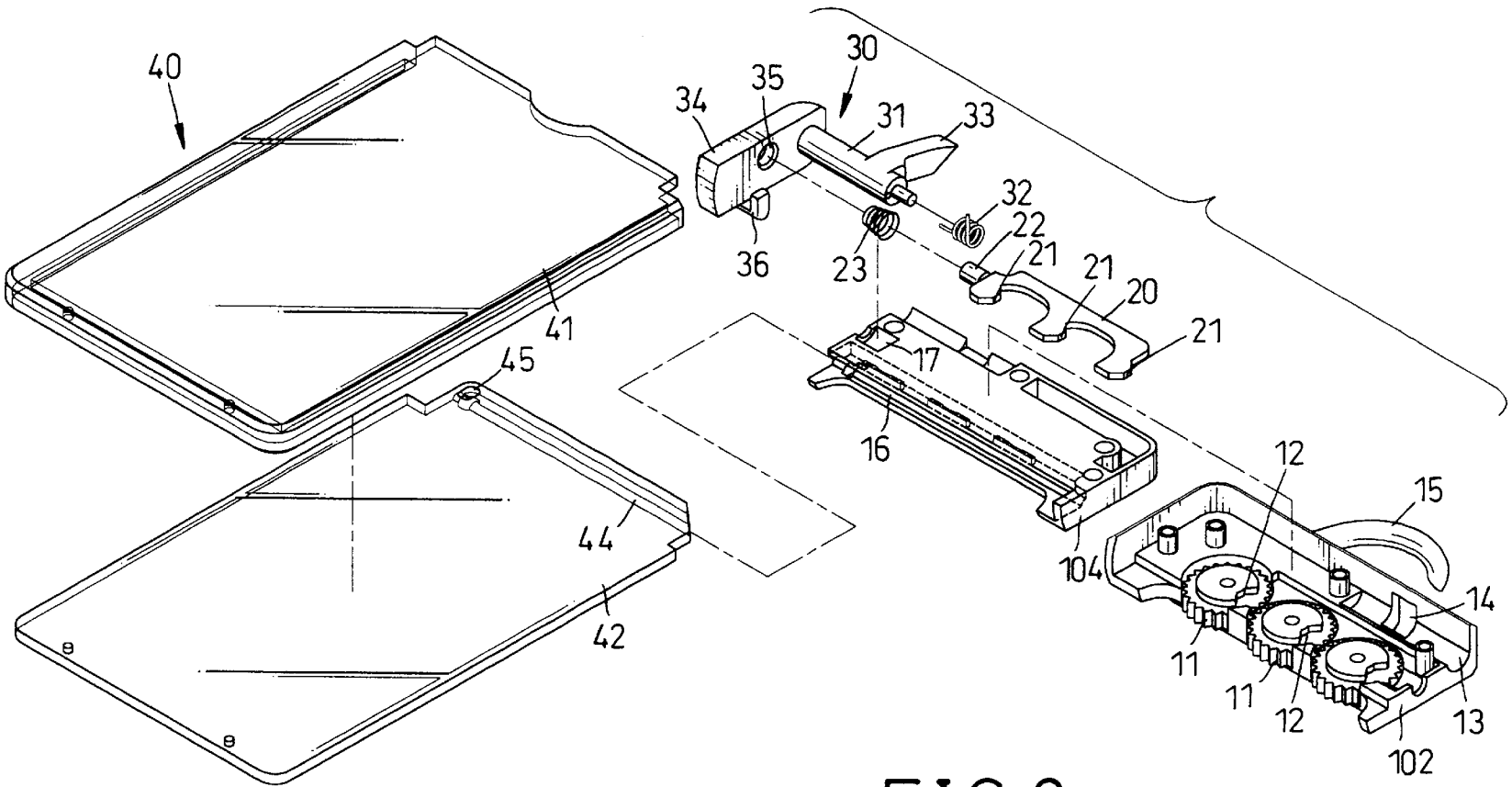
FIG. 2 is an exploded view of the present invention.

With reference to FIGS. 1 and 2, the present invention includes two main components which are a lock (10) and a name card case (40).

An upper cover (102) and a lower cover (104) are assembled together to form a housing of the lock (10). Multiple combination wheels (11) are rotatably received in the housing, wherein each combination wheel (11) has a cutout (12) defined therein. A bore (13) is defined in the housing and leads to an opening defined in a side of the housing. A slot (14) is defined through a surface of the upper cover (102) to communicate with the bore (13). A securing hook (15) extends from the surface of the upper cover (102). A guiding ridge (16) is formed on and across an inner surface of the lower cover (104). A notch (17) is defined through the lower cover (104) and locates close to the opening of the bore (13) when the upper and lower covers (102, 104) are combined.

A controlling piece (20) substantially "M" shaped is disposed in the housing and juxtaposed with the combination wheels (11). Multiple restricting edges (21) are formed on the controlling piece (20) to mate the cutouts (12) of the combination wheels (11). A peg (22) is formed on and extends from an end of the controlling piece (20). A spring (23) is mounted around the peg (22) and sandwiched between the peg (22) and an inner face of the housing.

A securing member (30) is engaged to the side of the housing and close to the notch (17). A shaft (31) extends from a face of the securing member (30) and extends into the bore (13) via the opening. A latch (33) is integrally connected with the shaft (31) and extends out of the housing via the slot (14) to engage the securing hook (15). A torsion spring (32) is sandwiched between the shaft (31) and an inner surface of the housing. A hole (35) is defined in the face of the securing member (30) to receive the peg (22). A positioning hook (36) is integrally connected with the securing member (30) to be received in the notch (17).

A top cover (41) and a bottom cover (42) are assembled together to form the name card case (40). A space is defined between the top cover (41) and the bottom cover (42) for receiving a name card, and the two covers (41 and 42) are both transparent so that information listed on the name card in the space can be observed. A groove (44) is defined in an outer surface of the bottom cover (42) and at an appropriate position to mate the guiding ridge (16). An aperture (45) is also defined in the outer surface of the bottom cover (42) and near an end of the groove (44) to communicate with the notch (17). Hence, the lock (10) and the name card case (40) are securely connected together by mating the guiding ridge (16) into the groove (44), and extending the positioning hook (36) into the notch (17) and the aperture (45).

Figure 3:
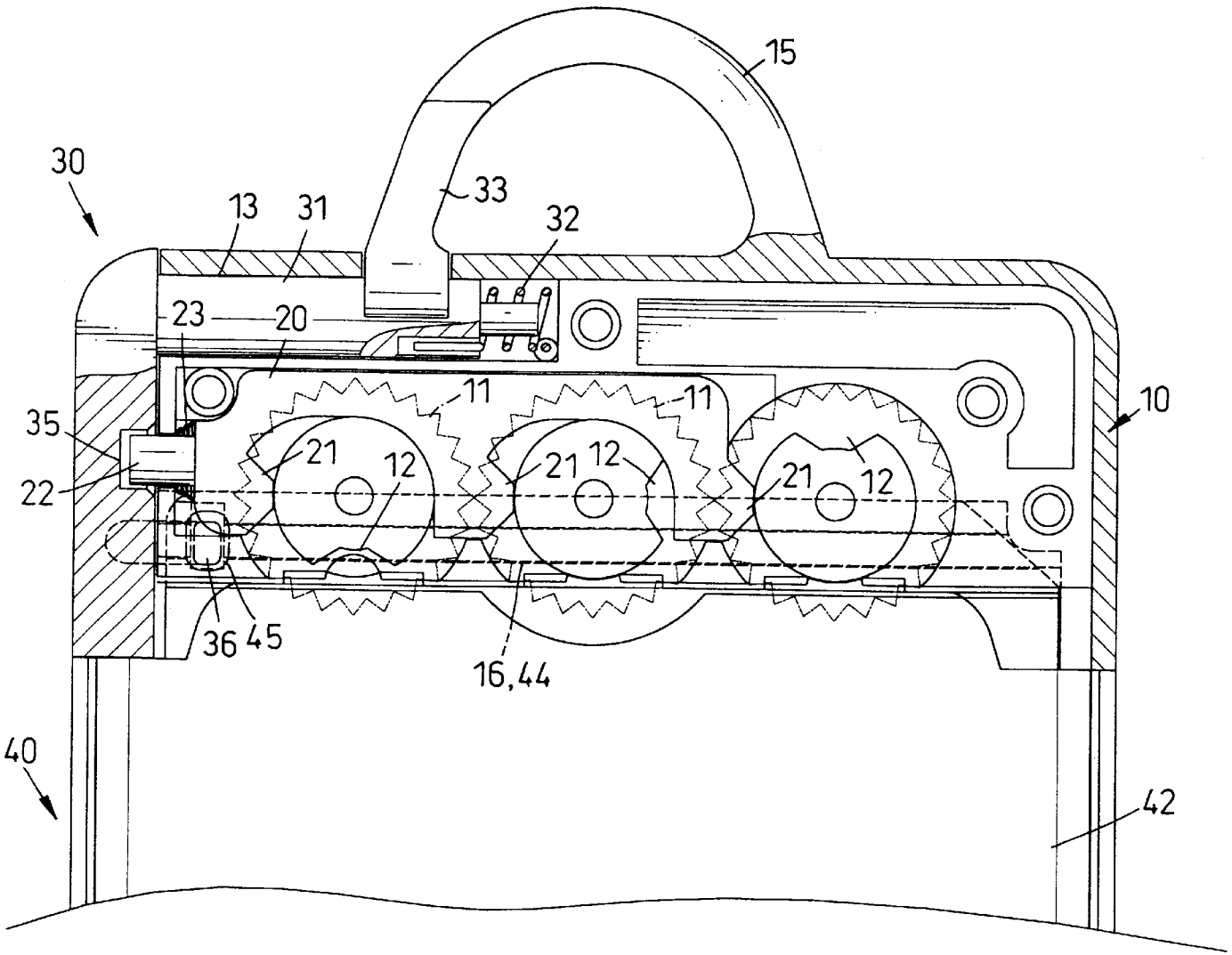
FIG. 3 is a cross-sectional view showing a securing state of the lock.
Figure 4:
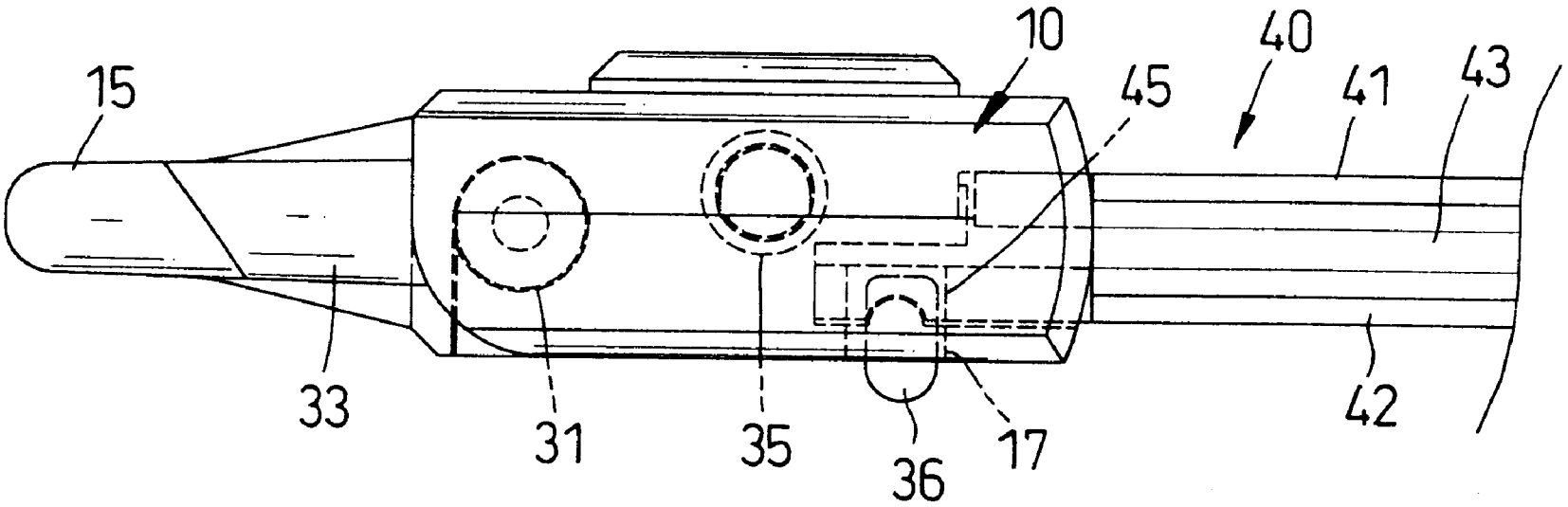
FIG. 4 is a side view showing the securing state of the lock.

With reference to FIGS. 3 and 4, when the combination wheels (11) are not correctly set, the peg (22) is received into the hole (35) so that the securing member (30) is secured with the controlling piece (20) and prevented from pivoting. At this moment, the lock (10) is at a securing state such that the latch (33) firmly engages the securing hook (15) to be looped to an item.

Figure 5:
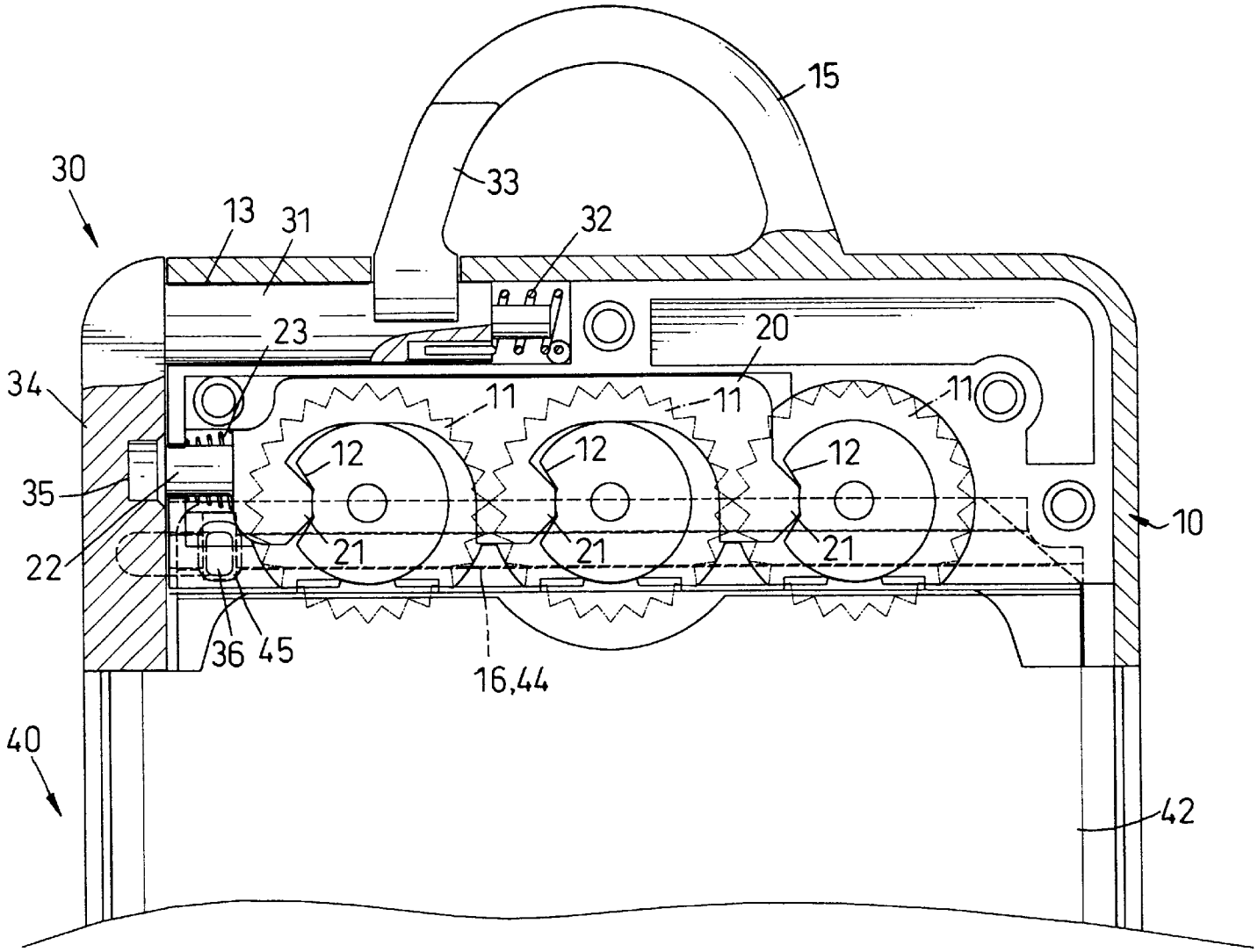
FIG. 5 is a cross-sectional view showing a releasing state of the lock.
Figure 6:
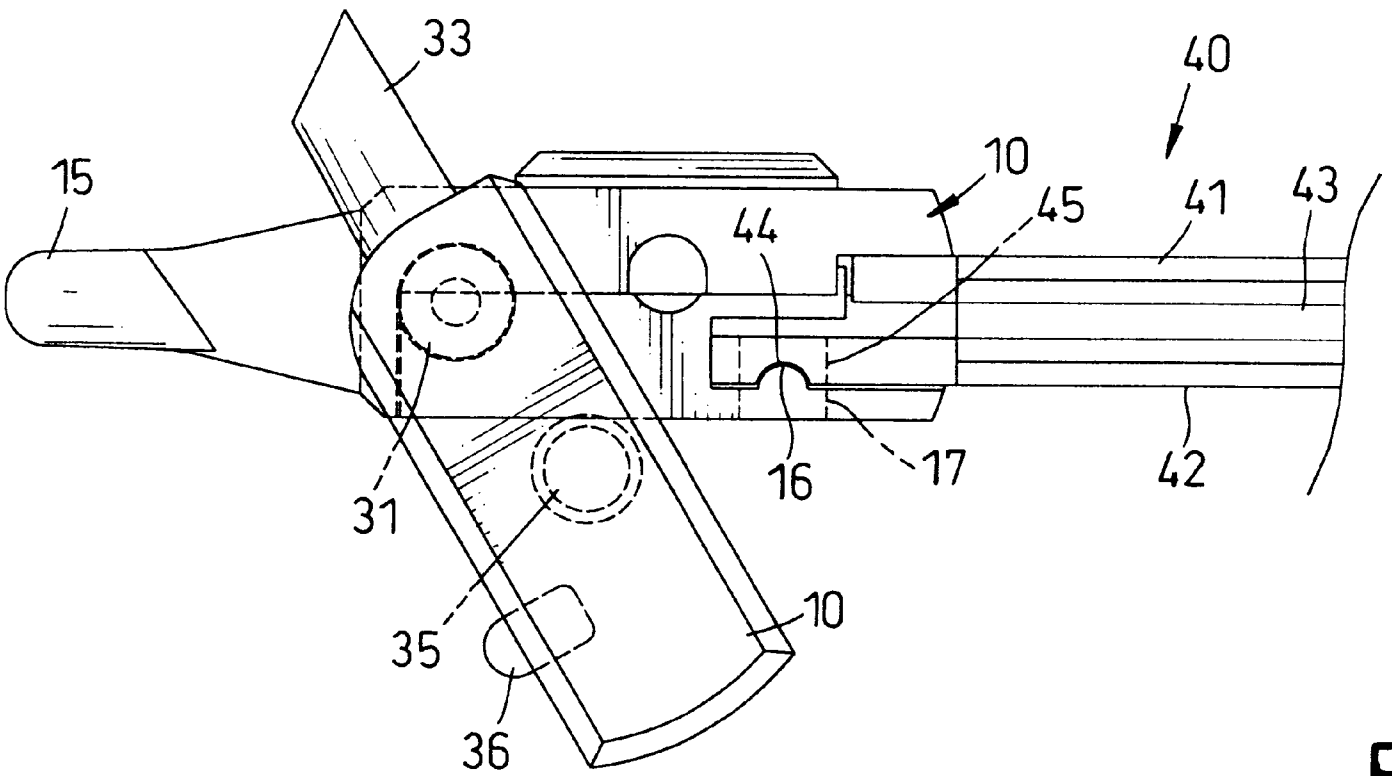
FIG. 6 is a side view showing the releasing state of the lock.

With reference to FIGS. 5 and 6, when the combination wheels are correctly set, due to a resilience provided by the spring (23), the controlling piece (20) is pushed to move slightly so that the restricting edges (21) are respectively received in the cutouts (12). At this moment, the peg (22) is no longer received in the hole (35) to restrict the securing member (30) from pivoting. Therefore, due to a torsional resilience provided by the torsion spring (32), the securing member (30) pivots automatically so that the latch (33) disengages the securing hook (15) and the lock (10) is now at a releasing state.

Figure 7:
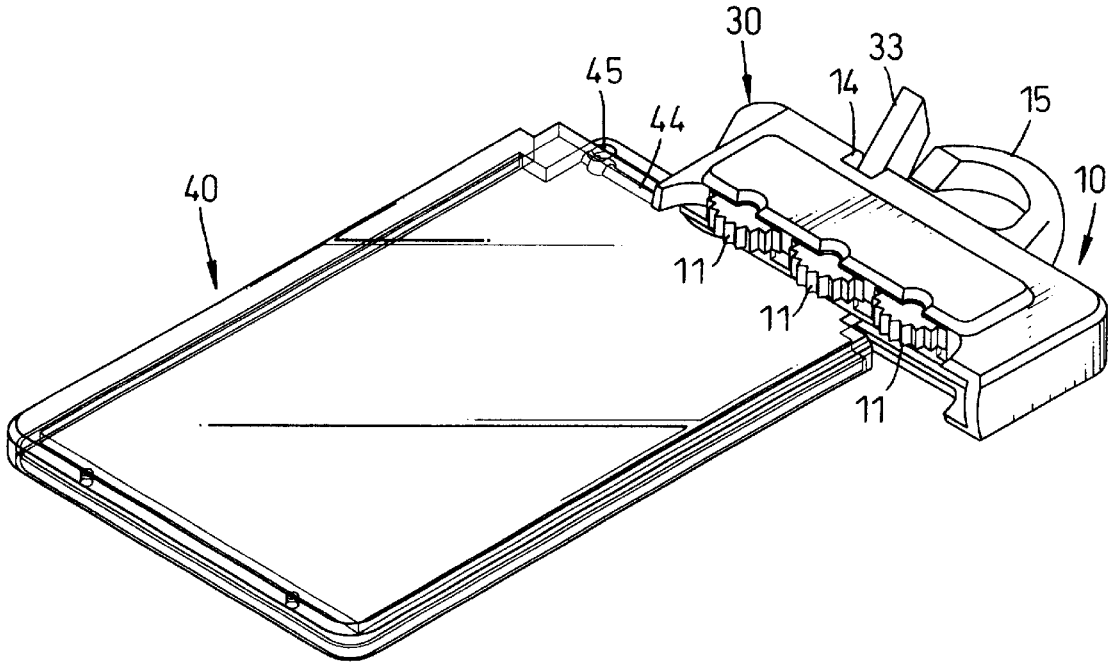
FIG. 7 is an operational, perspective view of the present invention when the lock is slid toward a side of the name card case.

With reference to FIG. 7, while the lock (10) is at a releasing state, the lock (10) can be slid toward a side of the name card case (40) to be separated with the name card case (40). Accordingly, the name card in the name card case (40) can be replaced. Moreover, after replacing the name card, the lock (10) can be slid onto the name card case (40) again by mating of the groove (16) and the ridge (44), and further pivoting the securing member (30) to extend the positioning hook (36) into the notch (17) and the aperture (45). Finally, by rotating the combination wheels (11) randomly, the lock (10) is set to the locking state as shown in FIGS. 3 and 4 and the name card is kept in the name card case (40) to provide an identification of the item.

It is noted from the above description that the present invention has the following advantages:

1. The lock (10) can be used for securing the item such as a luggage, and moreover the name card case (40) can be used to receive the name card for providing the identification of the item.
2. The name card is securely kept inside the name card case (40) and prevented from wear and tear that may render illegible the information listed on the name card.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lock in combination with a name card case, wherein the lock comprises:

a housing having a securing hook extended therefrom;

multiple combination wheels rotatably received in the housing and each combination wheel having a cutout defined therein;

a controlling piece slidably received in the housing and having multiple restricting edges formed thereon to respectively mate the cutouts, a peg extended from the controlling piece, a spring mounted around the peg and sandwiched between the controlling piece and the housing so that when the combination wheels are correctly set, the controlling piece is urged by the spring to receive the restricting edges into the cutouts;

a securing member having a shaft extended into the housing to be coupled at a side of the housing, a hole defined in the securing member to receive the peg, a latch extended from the securing member and out of the housing to engage the securing hook; and the name card case being transparent and slidably connected to the housing for receiving a name card, whereby when the lock is used to secure an item, the name card received in the name card case is able to provide an identification of the item.

2. The lock as claimed in claim 1, wherein the housing has a guiding ridge formed thereon and the name card case has a groove defined therein so that by mating of the guiding ridge and the groove, the name card case is slidably connected to the housing.

3. The lock as claimed in claim 1, wherein the housing has an upper cover and a lower cover assembled on the upper cover.

4. The lock as claimed in claim 1, wherein the name card case has a top cover and a bottom cover assembled on the top cover, and a space is defined between the top cover and the bottom cover to receive the name card.

5. The lock as claimed in claim 1 further comprising a torsional spring sandwiched between the shaft and the housing so that when the combination wheels are correctly set, the torsional spring urges the latch to automatically disengage with the securing hook.

6. The lock as claimed in claim 1, wherein the housing has a slot defined through a surface of the housing and the latch extends out of the housing via the slot.

7. The lock as claimed in claim 1 further comprising a positioning hook extending from the securing member, and a notch is defined through a surface of the housing to receive the positioning hook.

8. The lock as claimed in claim 7, wherein the transparent case has an aperture defined therein to communicate with the notch so that the positioning hook is able to be received in the notch and the aperture.

* * * * *